US011000721B2

(12) United States Patent
Budylina

(10) Patent No.: US 11,000,721 B2
(45) Date of Patent: May 11, 2021

(54) PROPORTION-BASED CIRCULAR EXERCISE APPARATUS

(71) Applicant: Tatyana Budylina, Staten Island, NY (US)

(72) Inventor: Tatyana Budylina, Staten Island, NY (US)

( * ) Notice: Subject to any disclaimer, the term of this patent is extended or adjusted under 35 U.S.C. 154(b) by 211 days.

(21) Appl. No.: 16/290,434

(22) Filed: Mar. 1, 2019

(65) Prior Publication Data

US 2019/0269955 A1 Sep. 5, 2019

Related U.S. Application Data

(60) Provisional application No. 62/638,195, filed on Mar. 4, 2018.

(51) Int. Cl.

| | |
|---|---|
| ***A63B 21/04*** | (2006.01) |
| ***A63B 21/00*** | (2006.01) |
| ***A63B 23/035*** | (2006.01) |
| ***A63B 21/06*** | (2006.01) |

(52) U.S. Cl.

CPC .... *A63B 21/0407* (2013.01); *A63B 21/00061* (2013.01); *A63B 21/00069* (2013.01); *A63B 21/06* (2013.01); *A63B 21/4034* (2015.10); *A63B 21/4035* (2015.10); *A63B 21/4045* (2015.10); *A63B 23/0355* (2013.01)

(58) Field of Classification Search

CPC ..... A63B 21/0407; A63B 21/4034; A63B 21/4035; A63B 21/4045; A63B 21/156; A63B 21/0552

See application file for complete search history.

(56) References Cited

U.S. PATENT DOCUMENTS

| | | | | |
|---|---|---|---|---|
| 2,953,394 | A * | 9/1960 | Anderson | A63B 19/02 280/207 |
| 5,102,122 | A * | 4/1992 | Piane, Jr. | A63B 21/156 482/103 |
| 6,685,600 | B1 * | 2/2004 | Ullman | A63B 21/156 482/100 |
| 6,705,976 | B1 * | 3/2004 | Piane, Jr. | A63B 21/154 482/102 |
| 7,335,141 | B2 * | 2/2008 | Piane, Jr. | A63B 21/055 482/101 |
| 7,507,190 | B2 * | 3/2009 | Piane, Jr. | A63B 21/00065 482/123 |
| 7,568,715 | B2 * | 8/2009 | Cooney | A63B 19/02 280/205 |
| 7,850,578 | B2 * | 12/2010 | Balaker | A63B 21/4045 482/70 |
| 7,887,471 | B2 * | 2/2011 | McSorley | A63B 23/0355 482/138 |
| 8,246,524 | B2 * | 8/2012 | Castillo | A63B 23/0227 482/92 |
| 9,827,462 | B2 * | 11/2017 | Siqueira | A63B 23/02 |
| 2002/0187880 | A1 * | 12/2002 | Johnson | A63B 19/02 482/78 |

* cited by examiner

*Primary Examiner* — Joshua T Kennedy

(57) ABSTRACT

A stationary circular exercise device for exercising via hand and foot platforms, which are removably encompassed in a track and are slideable along the circumference of a circular frame. Resistance to movement can be added with the use of cable or bands that are fixed at one or more locations along the track. Weights can also be attached by the use of pins or pegs, to the cables or bands to increase resistance.

16 Claims, 4 Drawing Sheets

PROPORTION-BASED CIRCULAR EXERCISE APPARATUS

PRIORITY CLAIM

This application claims priority to and incorporates in its entirety U.S. Provisional Application 62/638,195, filed Mar. 4, 2018.

BACKGROUND

There are currently many exercise devices that target either a single or multiple muscle groups, such as the bench press, deadweights, or various other machines or objects. There are exercise devices that are dedicated to aerobic exercise as well, such as treadmills and ellipticals. However, there is a lack of exercise devices that alternately or simultaneously provide for aerobic exercise as well as strength training.

SUMMARY

In one embodiment, the exercise apparatus may comprise a main body and a base, with the base being configured to support, stabilize, and lift the main body. The main body, being the principal frame of the apparatus and within which exercise takes place, may be of any feasible size or shape, but is preferably circular and features a diameter approximately equal to the height of the user when the arms are stretched directly upwards. The main body and base may be molded as one piece or molded separately and combined.

The main body may feature a track, with four separate platforms coupled to the track. The four platforms may feature two designated and configured to be gripped or otherwise fitted to the hands of the user, and two designated and configured to fit or otherwise contact the feet of the user. These platforms may be removably attached, permitting them to be replaced by alternate platforms characterized by varying shapes and sizes for use by the user. In particular, the platforms configured to fit feet, or "feet platforms", may come in various sizes to match the various sizes of human feet. Also, the platforms may be designed and configured to fit varying footwear or lack thereof. The "hand platforms" may feature a modular attachment surface, permitting the coupling and engagement of different kinds of handles. The handles may be oriented and constructed to provide for the various kinds of exercises a user may desire. For example, some handles may be flexible to enable a fluid motion vis-à-vis the platform and the user, whereas others may be firm or rigid to prevent or limit such motion. The handles may be orientated orthogonally with respect to the track, or parallel to it, or concentric with it, or at any angle between, thereby allowing the user to determine the arm muscles to be engaged. In one version, the handles are rotationally engaged to the hand platforms to enable the user to alternate the arm muscles used during a single session without having to change the handles. The handles may feature or lack grip pads.

The track may be one or more hollow cavities embedded in the main body. The platforms may couple to the track physically, by extending into the track through an exterior opening of the main body. Magnetic coupling may occur by the use of two magnets, with the first embedded in the cavities and the second embedded or otherwise attached to the platforms physically. Electrical coupling may work similarly, except that the magnetic components are magnetized via a continuous or sporadic electric current. Regardless of the manner of coupling, the platforms and track are configured so that the platform can move across, around, and/or toward/away from the track. This motion may be concentric with the main body of the exercise apparatus, or orthogonal to it.

In one version, the platforms may be configured to move away from the track and towards the center of the main body. This configuration allows the user to perform a contract-type exercise by pulling the handles toward the user's body, as well as to account for the change in distance between the user and the main body of the exercise apparatus as the user's arms are moved from, for example, an upwards orientation in line with the user's spine, to an outwards orientation orthogonal or at an angle with the user's spine.

Both aerobic and anaerobic exercise each require resistance specifically, the overcoming of resistance which may be provided, assisted, or increased by gravity, weight, distortion, and tension. Within the track, a set of one or more cables or bands may be disposed. These cables or bands may be fixed at one or more locations along the track in order to create a focal point from which tension may be obtained. These fixed locations may be permanently or temporarily established, with the latter type being determined, selected, and set by the user in order to control default or end positions in exercise motion. The cables or bands may also be fixed to the platforms, and fixation may occur by any reasonable means, including permanent or temporary welding, clamping, tying, hooking, binding, lassoing, pulleying, screwing, or winding. In one embodiment, a cable is attached to a first part of a platform, which may be removably coupled to a second part of the platform, thereby enabling the changing of the user-platform interface without disturbing the cable-platform interface. The cables or bands may be made of elastic material, the thickness and density thereof being selected in order to specify the resistance. In one embodiment, the cables or bands are connected to one or more weights. Pins or pegs may be used to connect the weights to the cables or bands in order to specify the weights that will be used during an exercise.

The weights may be internally or externally to the main body, and may be grouped together to increase resistance or separated and/or gradated. The weights may be of any suitable size, shape, and weight. In one variation, the weights are disc shaped or substantially flat and disposed within the track. If the weights are disposed externally to the main body, they may be disposed on or adjacent to the main body itself, albeit in an exterior space. In this embodiment, the weights, if engaged to the cables or bands, may slide up and down the track on a side adjacent or opposite the track accessed by the user. In another embodiment, the weights are stacked vertically in a frame external to the main body. These weights may be connected to the cables or bands which, in this embodiment, depart from the track of the main body via an external channel or guide, and are arranged along a channel or guide coupled to the frame.

DETAILED DESCRIPTION

Figure 1:
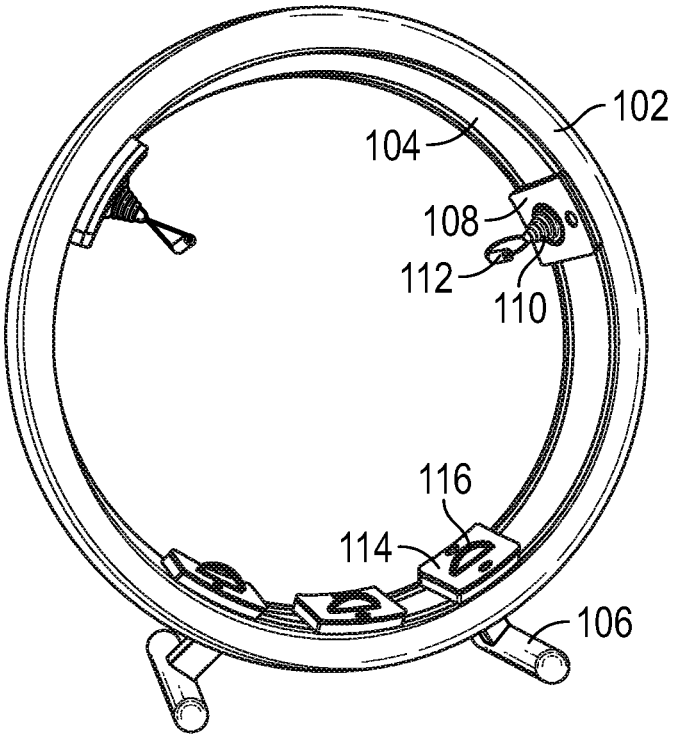
FIG. 1 shows an exemplary embodiment of the exercise device.
Figure 2:
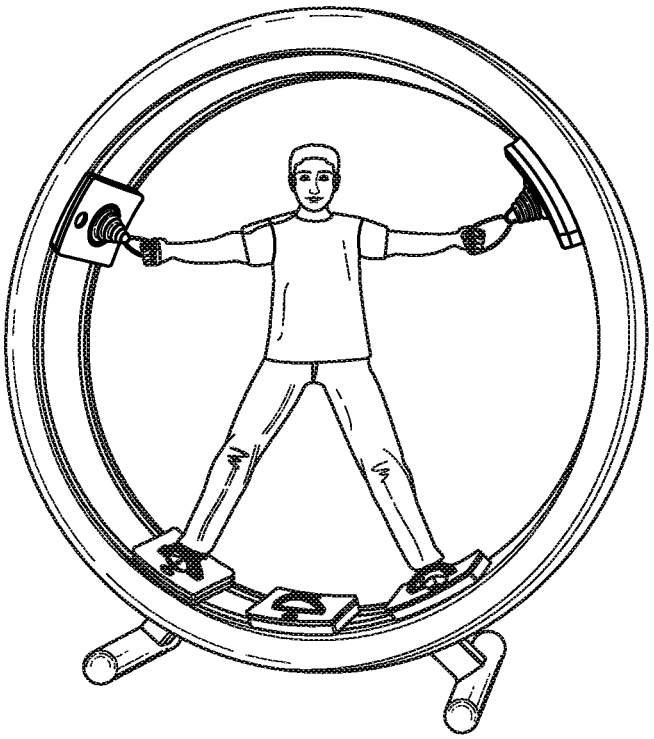
FIG. 2 shows an exemplary embodiment of the exercise device in use.

FIGS. 1-2 shows a circular main body 102 supported by a base 106 and featuring a track 104 embedded in an inner side of the main body. Also, various platforms, including hand platform 108 and foot platform 114 are coupled to the track. The hand platform may feature a handle 112 connected to the hand platform via a connection device 110. The connection device may be elastic or rigid, prevent or permit movement of the handle vis-a-vis the hand platform, with movement types including rotational, extension, compression, or elastic. The foot platform may feature a foot handle 116 which is configured to hold or support a user's foot.

Figure 3A:
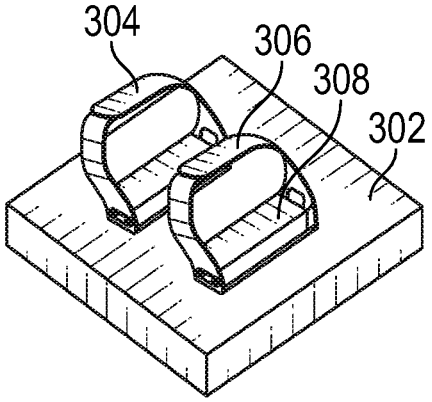
FIGS. 3*a-d* show exemplary foot and hand platforms.

FIG. 3*a* shows a foot platform 302 with foot handles 304 and 306, configured to guide and support the user's feet. The foot pad 308 may connect the foot handles to the platform and provide a comfortable contact surface for the feet.

Figure 3B:
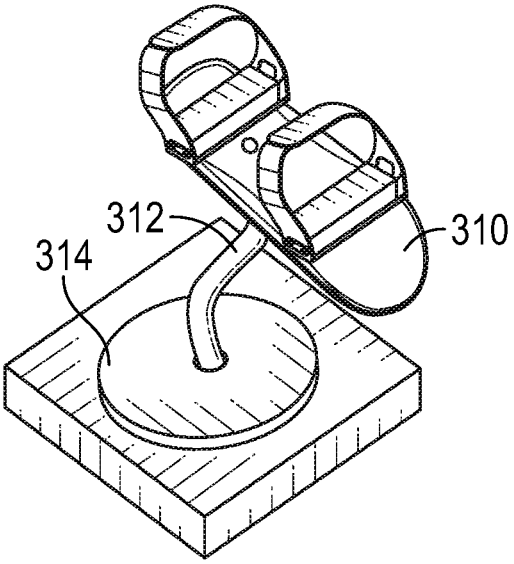

FIG. 3*b* shows a foot platform with a rotational disc 314, which permits rotation between the foot platform and the contact surface 310. The contact surface may be relatively rigid or flexible and may also feature foot handles. The contact surface may attach to the rotational disc by a rigid or elastic connection 312. In one version, the elastic connection attaches to the foot platform without the rotational disc.

Figure 3C:
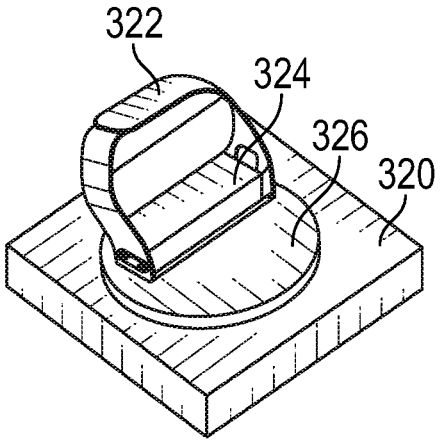
Figure 3D:
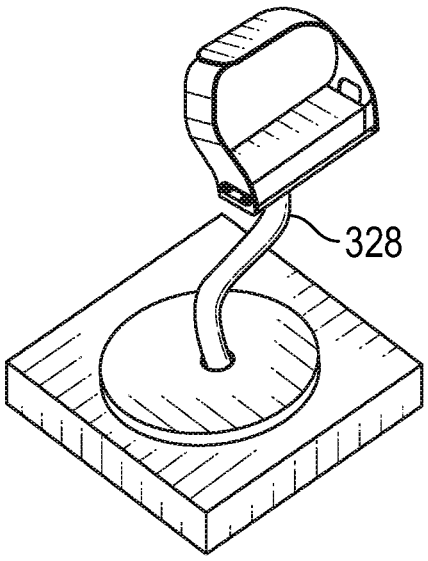

FIG. 3*c* shows a hand platform 320 with a handle 322 featuring a hand pad or rest 324 and a rotational disc 326, which may permit rotational movement between the handle and the hand platform. FIG. 3*d*. Shows a hand platform attached to a handle by an elastic connection or cable 328.

Figure 4A:
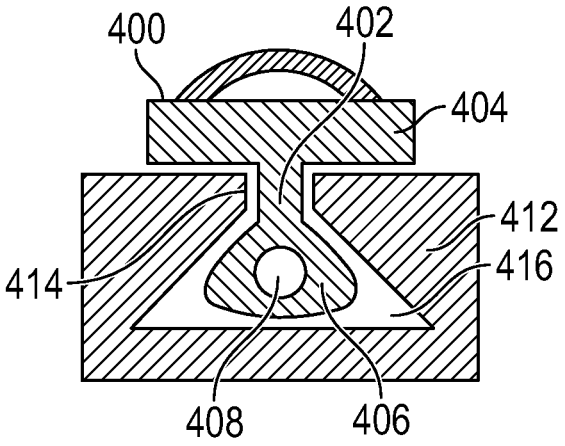
FIGS. 4*a-c* show exemplary platform, track, and cable embodiments.
Figure 4B:
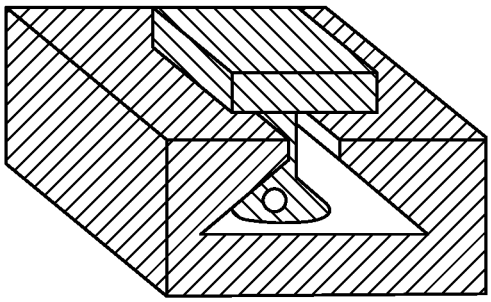
Figure 4C:
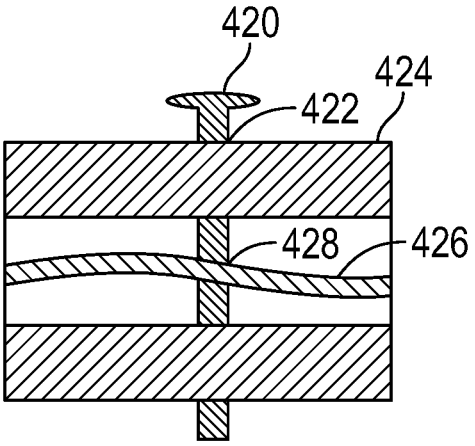

FIGS. 4*a-c* shows a platform 400 with a platform head 404, a platform arm 402, and a platform fist 406. The platform fist is thicker than the platform arm in order to impede it from being removed from the track 412 through the track entrance portion 414. The platform fist may be slidably engaged with the track pocket portion 416. The platform fist may feature a hole, clamping, or gripping feature 408 to engage with a tension or elastic cable or connection. The tension cable 426 may be fixed permanently or removably by a pin 420 placed through it and the track 424 via track hole 422 and cable hole 428.

Figure 5:
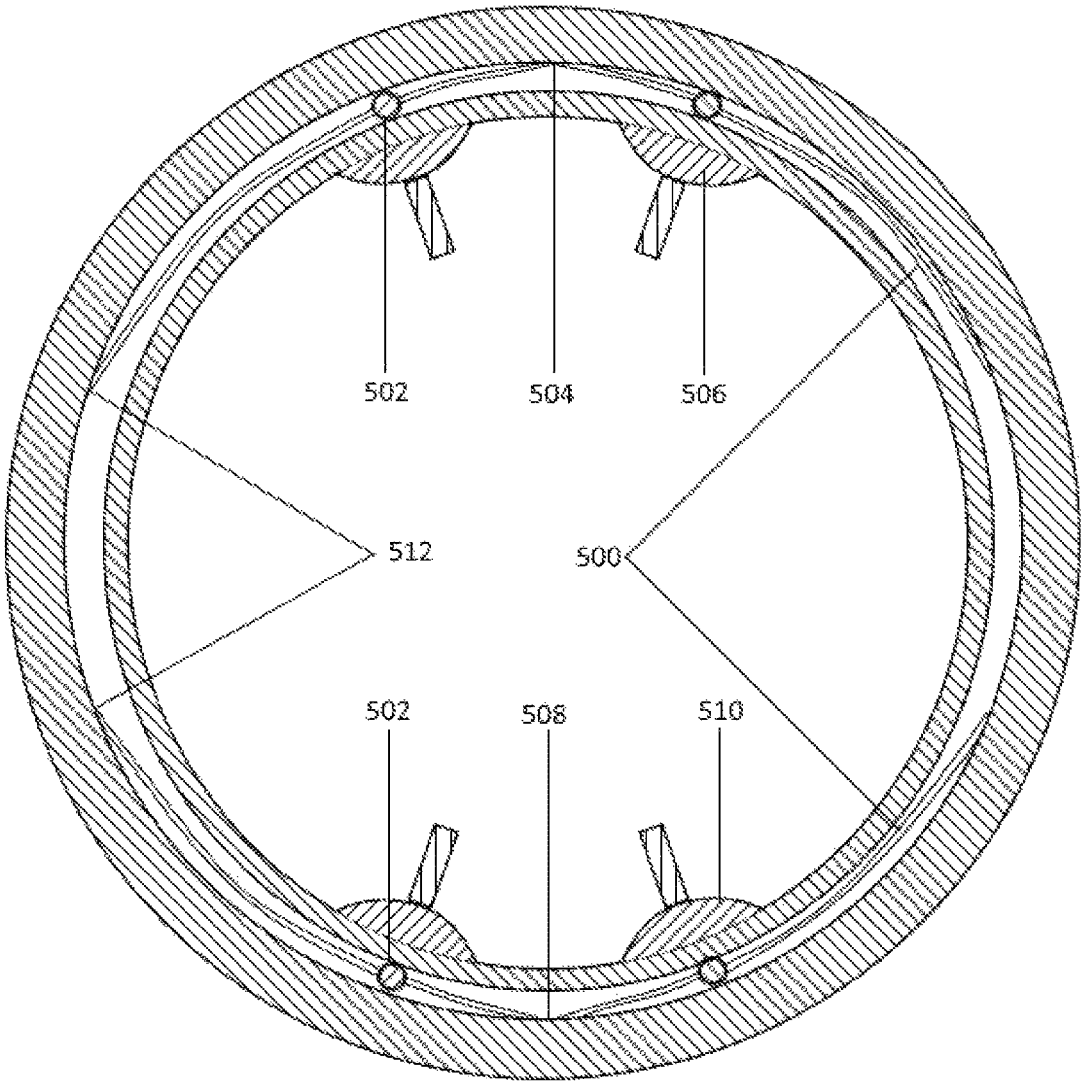
FIG. 5 shows exemplary resistant band configurations.

FIG. 5 shows resistance bands 500 being attached to the platform fists 502 at a point 504 between the two hand platforms 506, a point 508 between the two foot platforms 510, and a point 512 between a hand platform and a foot platform.

The invention claimed is:

1. A stationary exercise device configured to be used by a user and comprising:
- a main body; and
- a set of platforms;
  - the main body comprising a base and a frame defining a substantially circular shape;
    - the base configured to be placed on a ground and prevent the main body from moving;
- the circular frame being more than five feet in diameter, comprising an outer shell and a continuous inner track following the substantially circular shape of the frame, with the track embedded in the outer shell, and each platform of the set of platforms slidably engaged to the track;
  - the set of platforms including foot platforms configured to support or fit feet of the user allowing the user to stand on the platforms within the frame and hand platforms configured to support or be held by hands of the user.

2. The device of claim 1, the hand platforms featuring handles configured to be held by the user.

3. The device of claim 2, the handles being rigidly attached to the hand platforms.

4. The device of claim 2, the handles being rotationally attached to the hand platforms.

5. The device of claim 2, the handles being elastically attached to the hand platforms and configured to be pulled by the user away from the hand platforms.

6. The device of claim 1, the foot platforms including a friction tread surface.

7. The device of claim 1, the foot platforms having a contact surface, the contact surface configured to be in contact with footwear or the feet of the user and oriented substantially orthogonally with respect to a circumference of the track.

8. The device of claim 1, the foot platforms comprising foot attachments, the foot attachments being elastically attached to the foot platforms and configured to be pulled by the user away from the foot platforms.

9. The device of claim 1, the track being a hollow cavity, the hollow cavity having an entrance portion and a pocket portion, with the entrance portion being more narrow than the pocket portion.

10. The device of claim 9, each platform of the set of platforms comprising a fist and an arm, the fist being attached to a first end of the arm and the hand platform being attached to a second end of the arm, the arm being less thick than the fist, the fist being thicker than the entrance portion of the track and fitted and slidably engaged to the pocket portion of the track and the arm fitted and slidably engaged to the entrance portion of the track.

11. The device of claim 10, the fist configured to attach to a resistance cable, the resistance cable fixed to one or more portions of the track.

12. The device of claim 11, the resistance cable fixed to the track at a point between two hand platforms.

13. The device of claim 11, the resistance cable fixed to the track at a point between two foot platforms.

14. The device of claim 11, the resistance cable fixed to the track at a first point between a left foot platform and a left hand platform and at a second point between a right foot platform and a right hand platform.

15. The device of claim 11, the resistance cable being removably fixed to the track at various points using pegs or pins.

16. A stationary exercise device configured to be used by a user and comprising:
- a main body; and
- a set of platforms;
  - the main body comprising a base and a frame defining a substantially circular shape;
    - the base configured to be placed on a ground and prevent the main body from moving;
    - the circular frame being between five and seven feet in diameter, comprising an outer shell and a continuous inner track following the substantially circular shape of the frame, with the track embedded in the outer shell, and each platform of the set of platforms slidably engaged to the track;
  - the set of platforms including foot platforms configured to support or fit feet of the user allowing the user to stand on the platforms within the frame and hand platforms configured to support hands of the user;

the hand platforms featuring handles configured to be held by the user, the handles being elastically attached to the hand platforms and configured to be pulled by the user away from the hand platforms;

the foot platforms comprising foot attachments, the foot attachments being elastically attached to the foot platforms and configured to be pulled by the user away from the foot platforms.

* * * * *